US007795520B1

(12) United States Patent
Chen

(10) Patent No.: US 7,795,520 B1
(45) Date of Patent: Sep. 14, 2010

(54) PEDAL SYSTEM FOR A PERCUSSION INSTRUMENT

(76) Inventor: Kuo Chang Chen, 3F-5, No. 262, Sec. 2, Henan Rd., Situn District, Taichung City 407 (TW)

( * ) Notice: Subject to any disclaimer, the term of this patent is extended or adjusted under 35 U.S.C. 154(b) by 0 days.

(21) Appl. No.: 12/647,383

(22) Filed: Dec. 24, 2009

(51) Int. Cl.
*G10D 13/02* (2006.01)

(52) U.S. Cl. ..... 84/422.1
(58) Field of Classification Search ..... 84/422.1, 84/422.2, 422.3
See application file for complete search history.

(56) References Cited

U.S. PATENT DOCUMENTS 7,709,716 B1 * 5/2010 Chen ..... 84/422.1
* cited by examiner

*Primary Examiner*—Kimberly R Lockett

(57) ABSTRACT

A pedal system for a percussion instrument includes a support element. The support element includes a pedal, at least one upright frame, a positioning unit and a rotatable axle. A connecting shank and a connecting body are disposed on the axle. A transmission element connects the pedal with the connecting shank. A resilient member has a first end and a second end. The first end of the resilient member is connected to the connecting body, and the second end of the resilient member is connected to a linkage member. The linkage member is rotatable about an axial pin, in which a distance between the axial pin and the second end of the resilient member is adjustable. As such, the friction and the noise caused when the resilient member is stretching or compressing can be mitigated.

5 Claims, 9 Drawing Sheets

PEDAL SYSTEM FOR A PERCUSSION INSTRUMENT

BACKGROUND OF THE INVENTION

1. Field of the Invention

The present invention relates to a percussion instrument, and more particularly to a pedal system for a percussion instrument.

2. Description of the Prior Art

Some of the conventional drum assemblies each includes a pedal system for the player to percuss the drum with his/her foot. The pedal system is usually provided with a resilient means to retain the pedal at the release position while not stepped upon.

U.S. Pat. No. 6,713,667 discloses a pedal system having such resilient means, in which a lower end of the resilient member is connected to a roller which is rotatable to reduce friction. However, the distance between the roller and the resilient member is fixed.

SUMMARY OF THE INVENTION

The main object of the present invention is to provide a pedal system whose axial pin is position-adjustable.

To achieve the above and other objects, a pedal system of the present invention includes a support element. The support element includes a pedal, at least one upright frame, a positioning unit and a rotatable axle. A connecting shank and a connecting body are disposed on the axle. A transmission element connects the pedal with the connecting shank. A resilient member has a first end and a second end. The first end of the resilient member is connected to the connecting body, and the second end of the resilient member is connected to a linkage member. The linkage member is rotatable about an axial pin, in which a distance between the axial pin and the second end of the resilient member is adjustable. As such, the friction and the noise caused when the resilient member is stretching or compressing can be mitigated.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
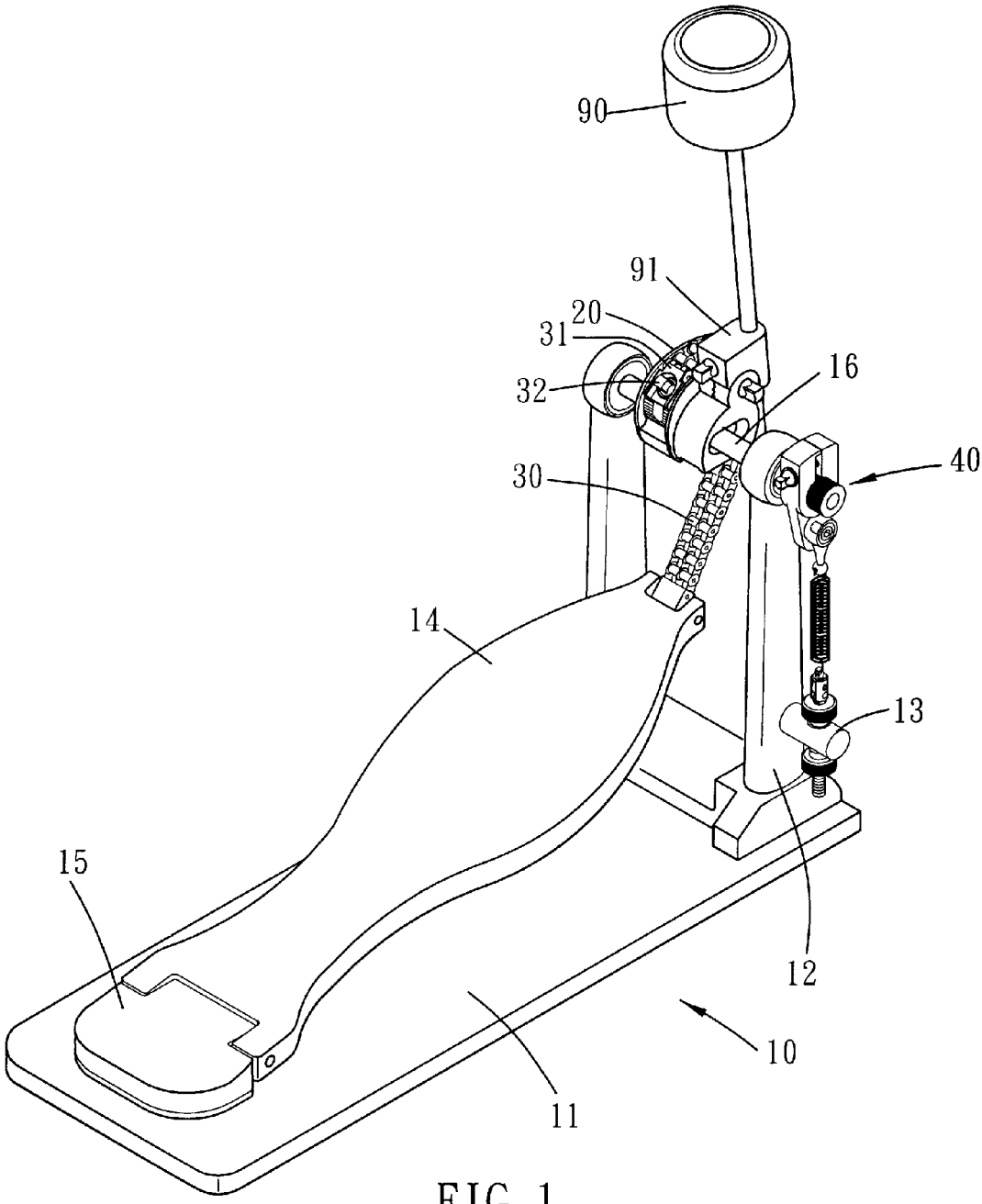
FIG. 1 is a perspective view showing a pedal system of the present invention.

Please refer to FIG. 1. A pedal system may be provided with a drum hammer 90 to percuss a percussion instrument, such as a drum.

The pedal system includes a support element 10, a connecting shank 20, a transmission element 30 and a returning element 40.

Figure 2:
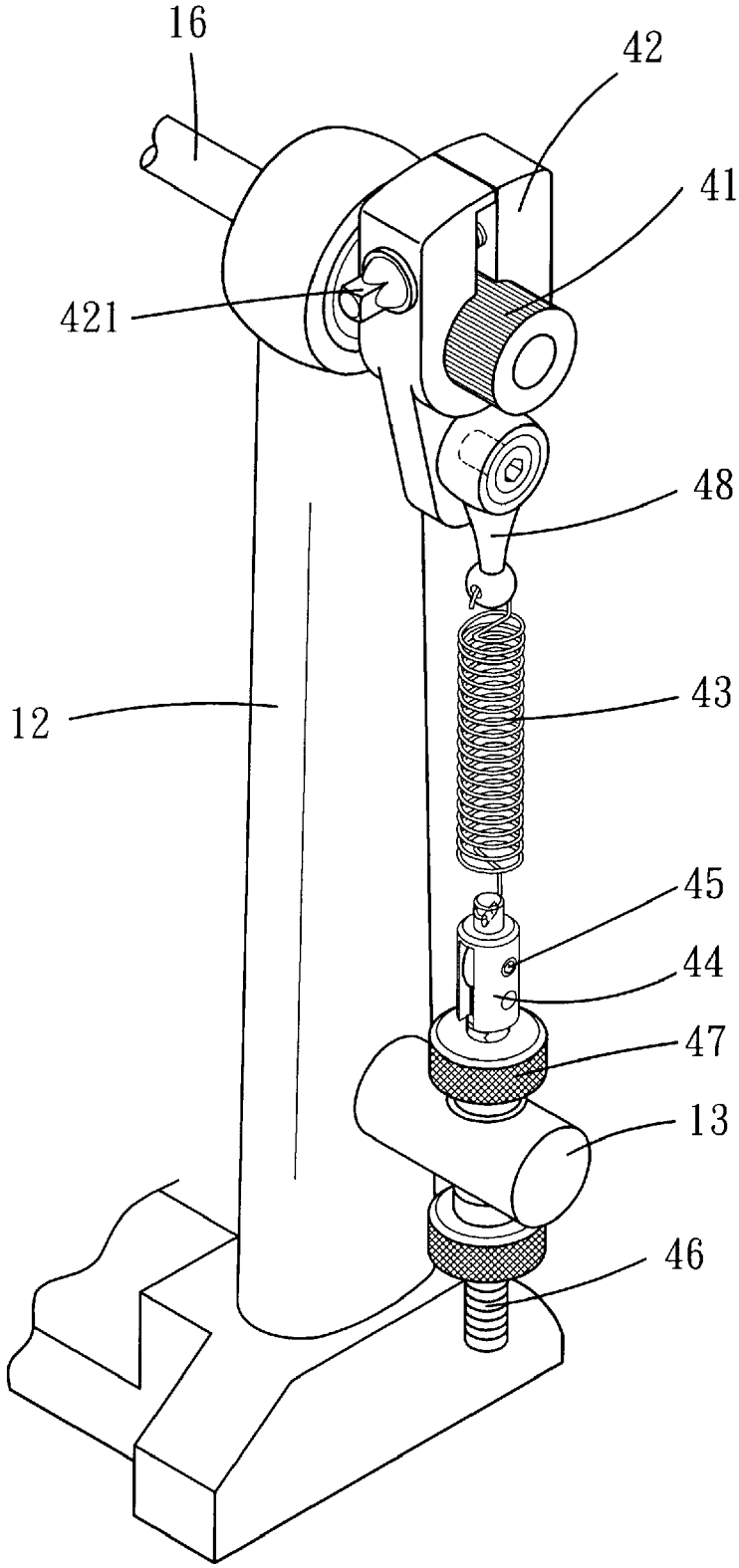
FIG. 2 is a partial enlarged drawing of FIG. 1.
Figures 3, 3A:
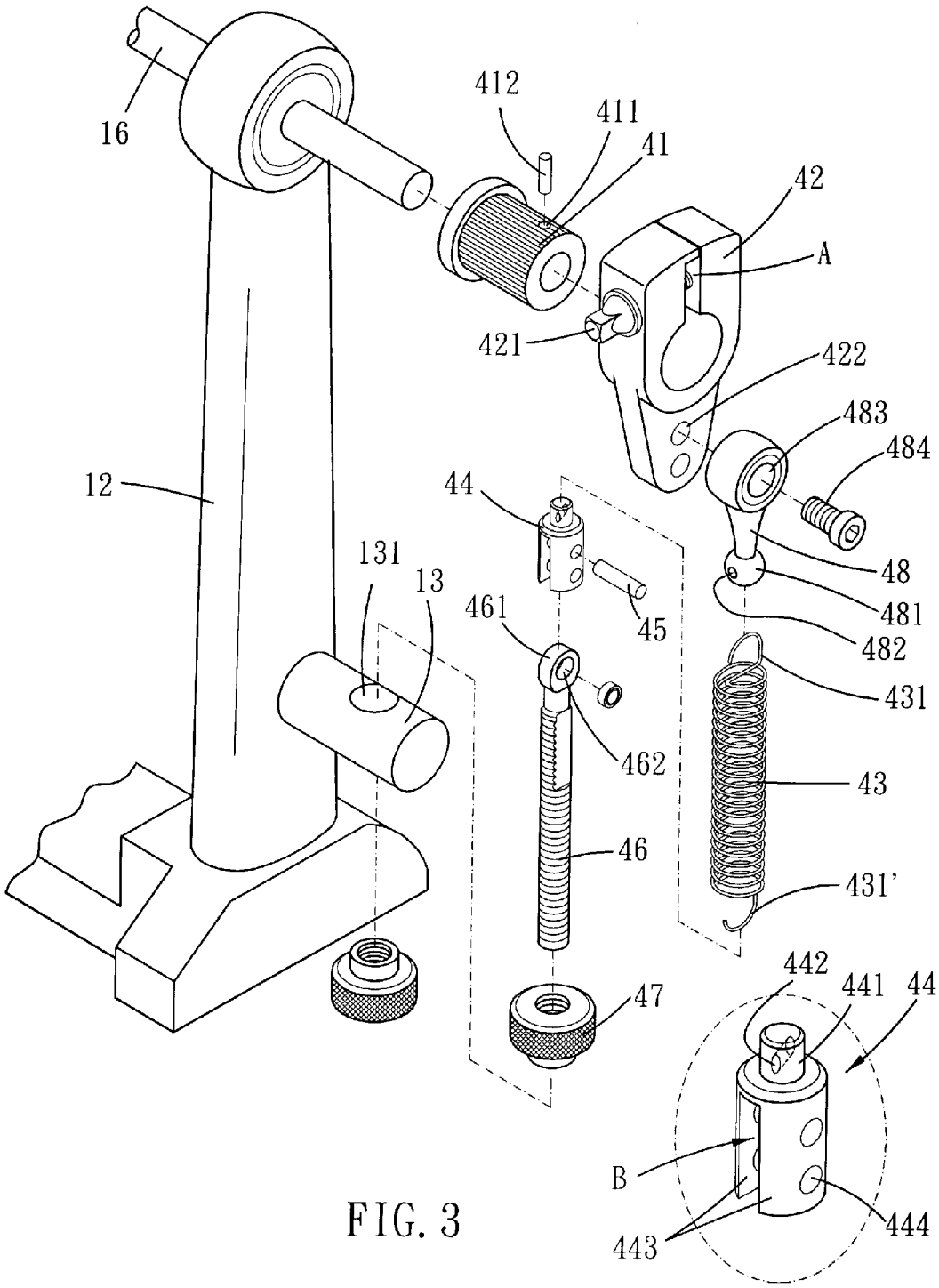
FIG. 3 is a partial breakdown drawing showing a pedal system of the present invention.
FIG. 3A is a perspective view showing a linkage member of the present invention.

Please refer to FIG. 1 to FIG. 3. The support element 10 includes a pedal base 11, two upright frames 12 and a positioning unit 13. The upright frames 12 are installed at one end of the pedal base 11, while another end of the pedal base 11 pivots a pedal 14. Thus the pedal 14 is swayable between a release position and a percussion position. A pivoting plate 15 can be further provided to pivot the pedal 14 on the pedal base 11. The distal ends of the upright frames 12 are rotatably installed with an axle 16. Note that the axle 16 can also be supported by a single upright frame. The positioning unit 13 is disposed on one of the frames 12 and locates remote from the axle 16. The positioning unit 13 is formed with a through hole 131, as shown in FIG. 3. In other embodiments of the present invention, the positioning unit 13 may also be disposed on other positions of the support element 10.

The connecting shank 20 is disposed on the axle 16. In an embodiment of the present invention, the connecting shank may have a non-circular bore to sleeve around a non-circular section of the axle, so that the shank and the axle can be in a rotational operative relationship. In another embodiment of the present invention, the connecting shank has a circular bore to sleeve on the axle. The connecting shank can fixed on the axle in a threaded manner. As such, a rotational operative relationship between the shank and the axle can also be achieved.

The transmission element 30 can be a chain. The transmission element 30 has a fixation device at one end thereof. The fixation device includes a teeth body 31 and a threaded unit 32. The teeth body 31 has a plurality of teeth facing the connecting shank 20. The threaded unit 32 can be threadedly disposed on the connecting shank 20 such that the teeth body 31 can be urged to tightly abut against the shank 20. Another end of the transmission element 30 connects to the distal end of the pedal 14. As such, the pedal 14 and the transmission element 30 are in a motional operative relationship. Note that the transmission element may also be a belt or a connecting rod set. Other fixation device may also be provided to adjust the distance between the pedal and the connecting shank.

The returning device 40 includes a skidproofing sleeve 41, a connecting body 42, a resilient member 43, a linkage member 44, an axial pin 45, a rod member 46 and two nuts 47. Please refer to FIG. 2 and FIG. 3. The skidproofing sleeve 41 is substantially a short tube with grooves axially disposed around its outer periphery. The grooves may also be slightly slanted to the axial direction of the skidproofing sleeve 41. The sleeve 41 sleeves on the axle and has a fixation bore 411 for a pin 412 to insert therethrough, and a part of the pin 412 is then inserted in the axle. As such, the skidproofing sleeve 41 and the axle 16 are also in a rotational operative relationship. The connecting body 42 is substantially C-shaped and has an opening A. A screw 421 is mounted on the connecting body 42 to narrow the opening A, so that the connecting body 42 can tightly clamp the skidproofing sleeve 41. A rotational operative relationship between the connecting body 42 and the axle 41 is, therefore, achieved. The connecting body 42 is formed with at least one inserting bore 422.

The resilient member 43 has a first end and a second end. The first end of the resilient member 43 is connected to the connecting body 42. In the present embodiment, the first end of the resilient member 43 is bent to form a hook portion 341. The hook portion 431 hooks a jointer 48. A lower end of the jointer 48 is formed with a boss 481 where a hook bore 482 is disposed for the hook portion 341 to hook. The jointer 48 is further formed with a pin bore 483. A pin 484 is inserted through the pin bore 483 and then is inserted and threaded in one of the inserting bores 422. Thereby, the first end of the resilient member is indirectly connected to the connecting body and is therefore rotatable with respect to the connecting body. In other embodiments of the present invention, the first end of the resilient member can be formed in a coil shape to surround the boss. Or, the hook portion of the resilient member can directly hook the connecting body so as to maintain a motional operative relationship between the resilient member and the connecting body.

The second end of the resilient member 43 is connected to the linkage member 44. Preferably, the second end of the resilient member 43 is also bent to form a hook portion 431'. Please refer to FIG. 3 and FIG. 3A. The upper end of the linkage member 44 is formed with a protrusive pole 411 where a transverse bore 442 is disposed for the hook portion 431' to hook. The lower end of the linkage member 44 is split into two arms 443 with a receiving space B defined therebetween. The linkage member 44 is formed with multiple bore sets, each of which has two axial bores 444 disposed on the arms 443 respectively. In other embodiments of the present invention, the linkage member 44 may be formed with only one arm, and each bore set includes only one axial bore disposed on that single arm.

Figure 4:
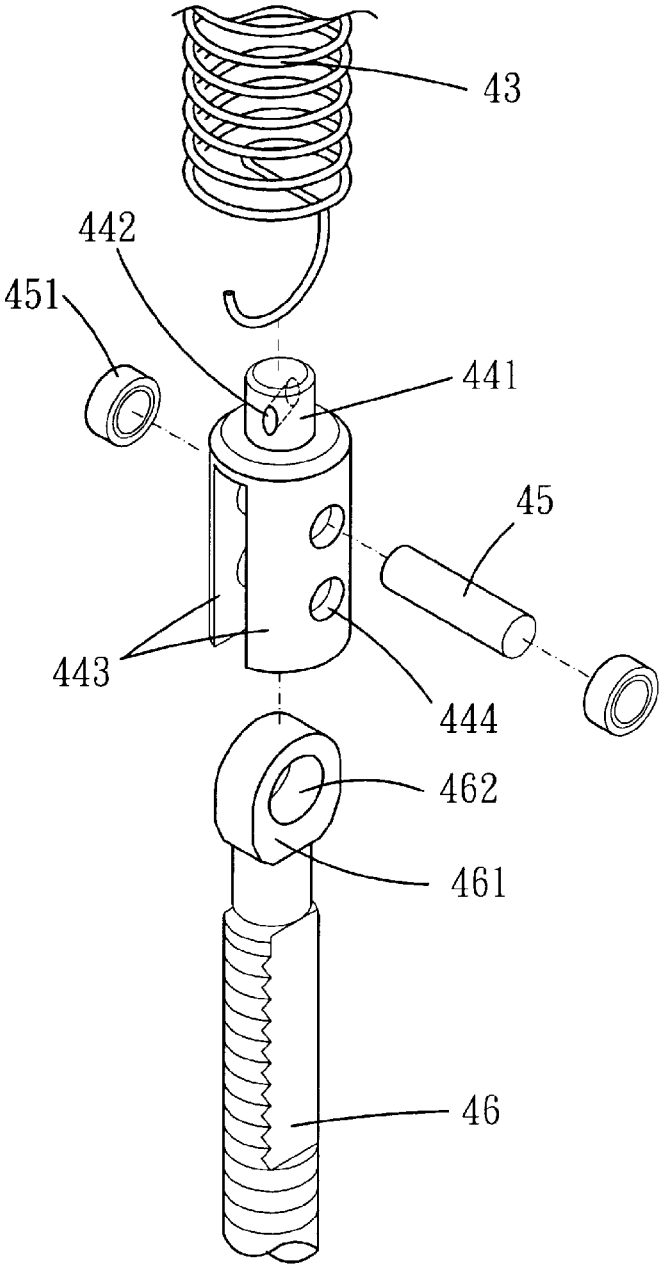
FIG. 4 is a breakdown drawing showing a connecting mechanism between a resilient member and a rod member of the present invention.
Figure 5:
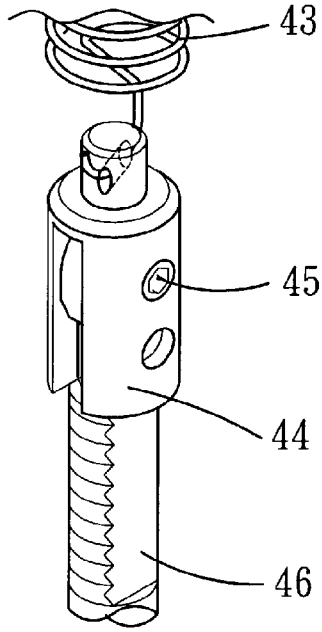
FIG. 5 is a perspective view showing a connecting mechanism between a resilient member and a rod member of the present invention.
Figure 6:
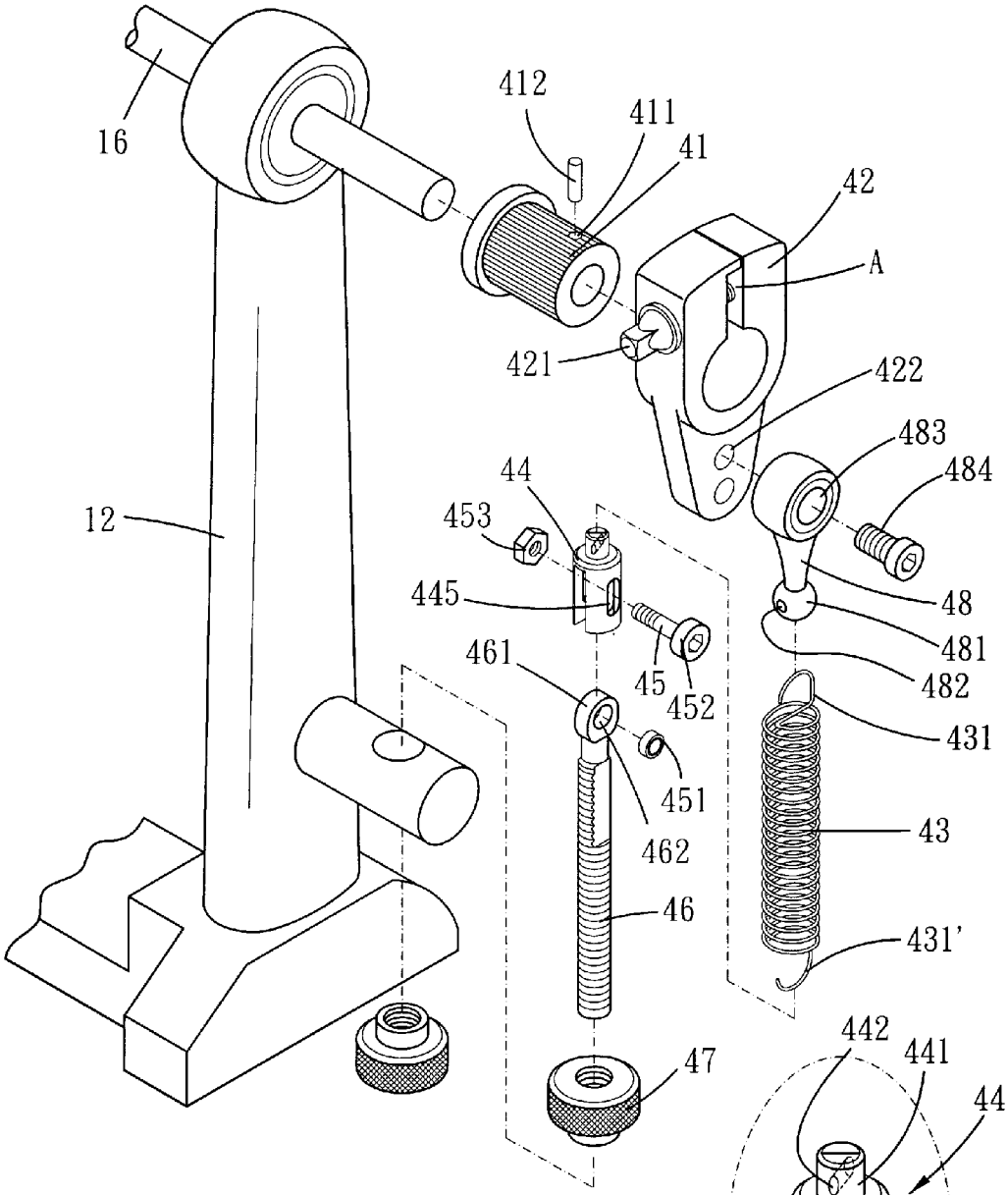
FIG. 6 is a partial breakdown drawing showing another pedal system of the present invention.
Figure 6A:
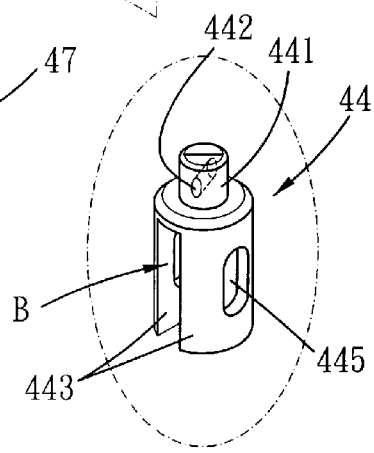
FIG. 6A is a perspective view showing another pedal system of the present invention.

The axial pin 45 is detachably inserted into one of the bore sets, i.e. a pair of the bores 444, so that a distance between the axial pin 45 and the second end of the resilient member 43 is adjustable. And the axial pin 45 is rotatable in the axial bores 444. Please refer to FIG. 4 and FIG. 5. Bearings or the likes can be disposed between the axial pin 45 and the linkage member 44 to reduce friction. Please refer to FIG. 6 and FIG. 6A. In another embodiment of the present invention, the linkage member 44 is formed with a longitudinal slot 445, in which one end of the longitudinal slot 445 is more remote from the resilient member 43 than the other end thereof. The axial pin 45 is slidably inserted in the longitudinal slot 445, and it is selectively fixed at a position between both ends of the longitudinal slot 445. More specifically, the axial pin 45 has a head portion 452 and a body portion axially extending from the head portion 452, and a distal end of the body portion is threaded to mate with a nut 453 so that the axial pin 45 can be fixed on the linkage member 44. Note that the axial pin in such embodiment is not rotatable with respect to the linkage member since the head portion 452 and the nut 453 tightly clamp the linkage member.

The rod member 46 has an upper end 461 being formed with a radial bore 462. The upper end 461 is trimmed to form two parallel plane surfaces so that the upper end 461 is slightly flat. The upper end 461 has a width slightly smaller than that of the receiving space B. That is, the upper end 461 can be inserted into the receiving space B, and the axial pin 45 can insert through the radial bore 462 so that the linkage member 44 can be rotatable with respect to the rod member 46 about the axial pin 45. Bearings 451 and the likes may also be disposed between the axial pin 45 and the radial bore 462 to reduce friction.

The other part of the rod member 46 is threaded, and the rod member 46 inserts through the through hole 131 of the positioning unit 13. The two nuts 47 are threaded on the rod member 46 at opposite sides of the positioning unit 13. The nuts 47 can be turned to move along the rod member 46. As such, the rod member 46 is height-adjustably disposed on the positioning unit 13. Note that the upper nut is not absolutely necessary but is omittable.

Figure 7:
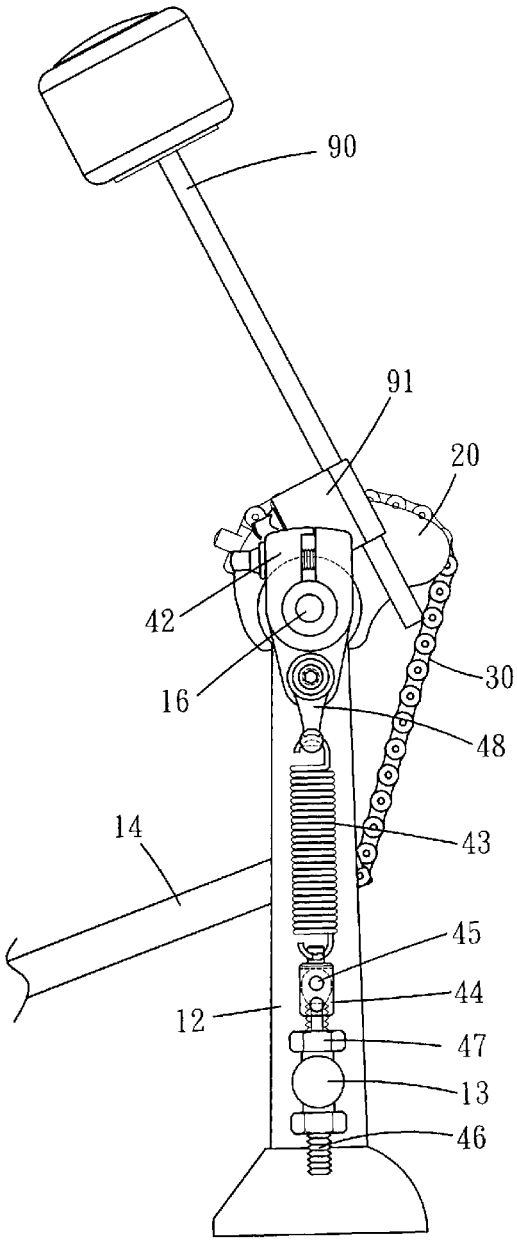
FIG. 7 is a lateral view showing a pedal system of the present invention.
Figure 7A:
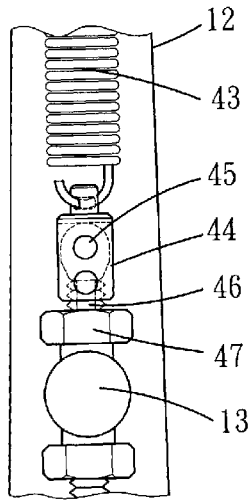
FIG. 7A is a partial enlarged drawing of FIG. 7.

Please refer to FIG. 1, FIG. 7 and FIG. 7A. Once the pedal system of the present invention is assembled, the pedal 14, the transmission element 30, the connecting shank 20, the axle 16, the connecting body 42, the resilient member 43 and the linkage member 44 are all in a motional operative relationship. The resilient member 43, therefore, provides a resilient force to retain the pedal 14 at the release position when the pedal 14 is not stepped upon. The axle 16 may be further provided with a hammer base 91 for the drum hammer 90 to install thereon. Note that the hammer 90 may also be directly installed on the connecting shank or the axle.

Figure 8:
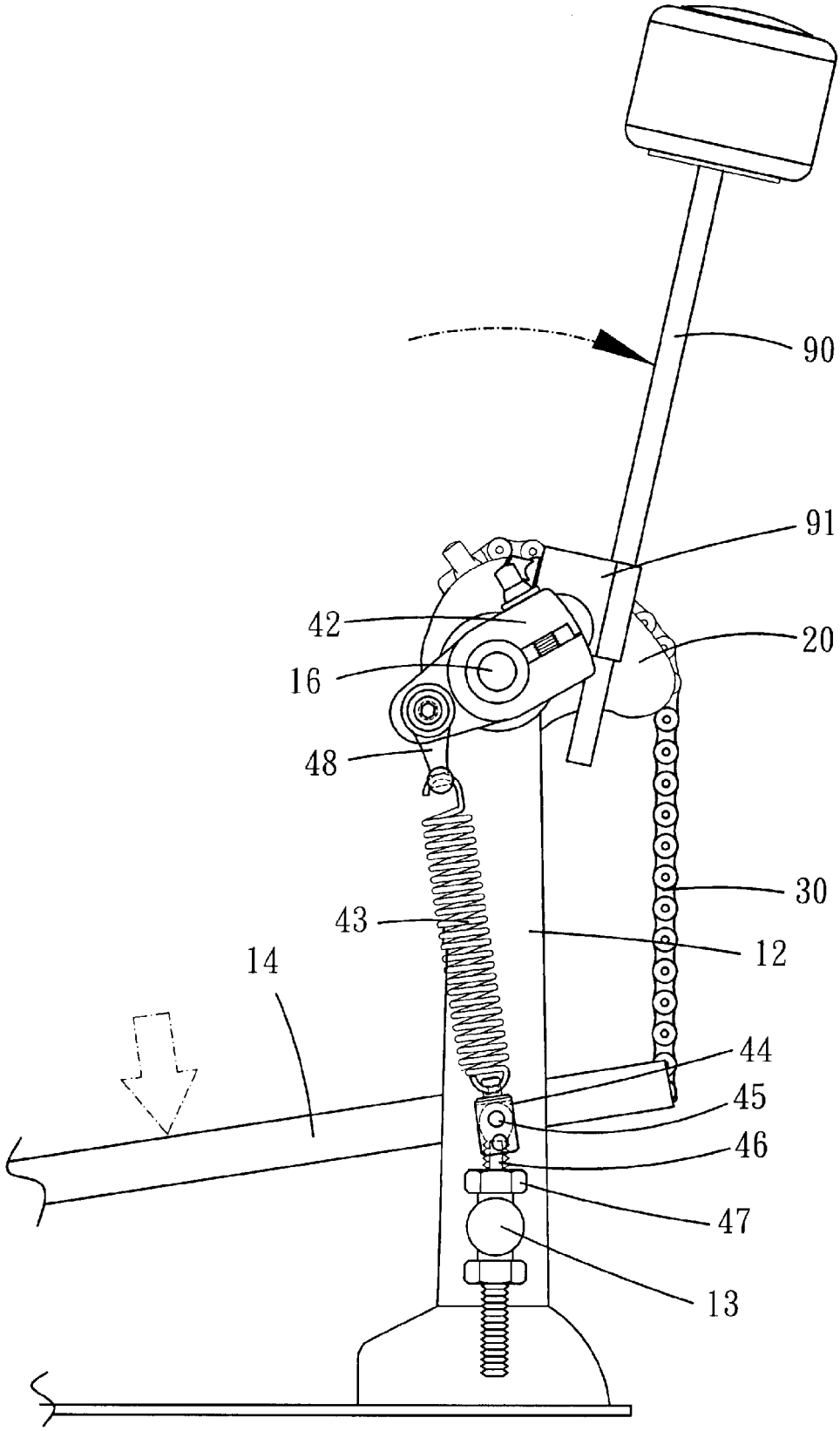
FIG. 8 is a lateral view showing a pedal system of the present invention.
Figure 9:
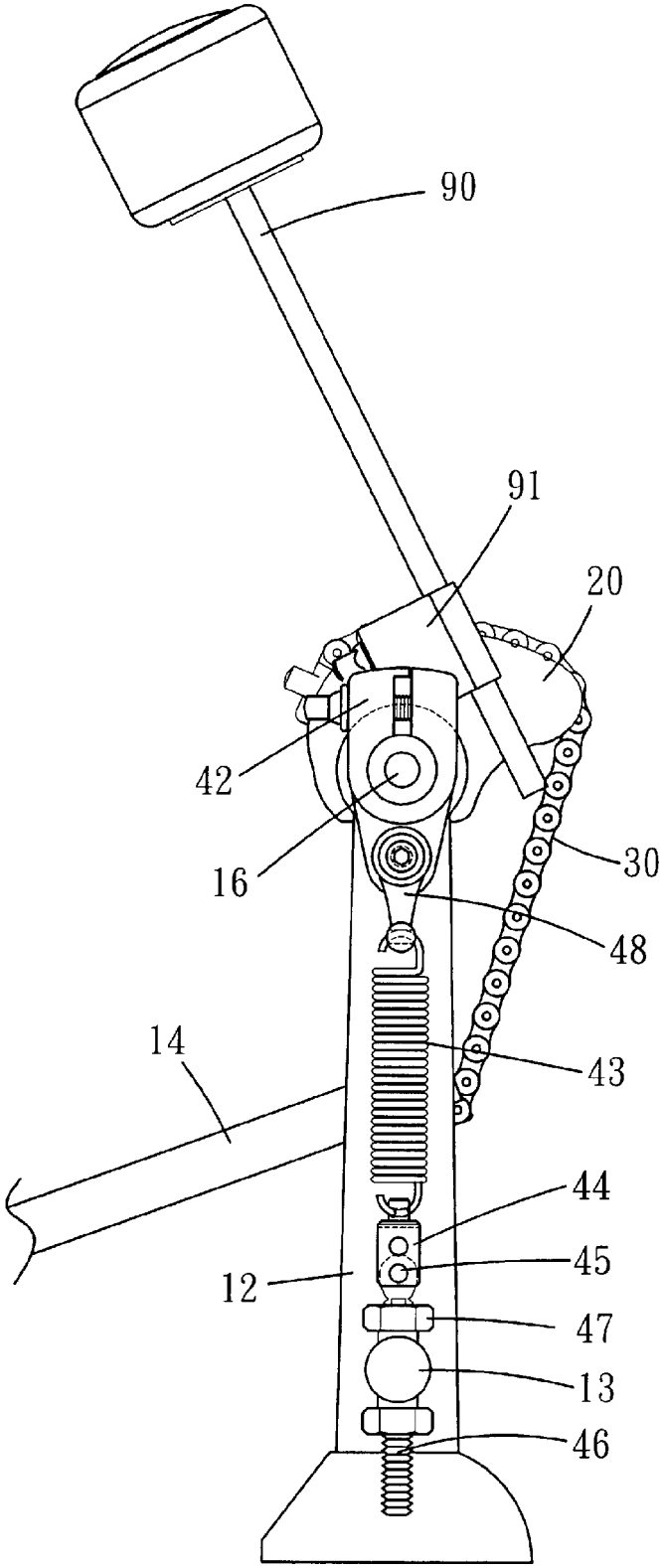
FIG. 9 is a lateral view showing a pedal system of the present invention.
Figure 10:
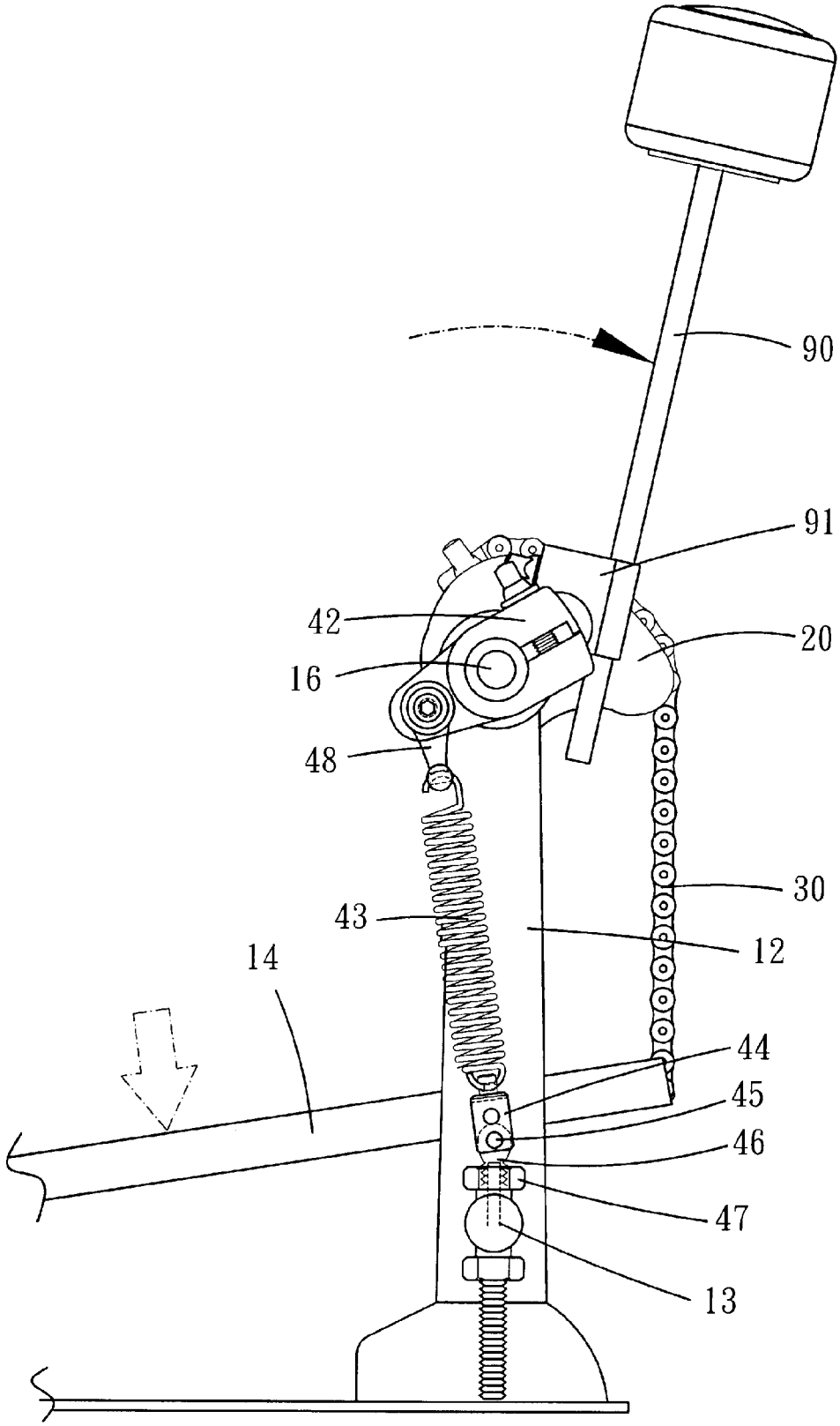
FIG. 10 is a lateral view showing a pedal system of the present invention.

Please refer to FIG. 8. The pedal 14 is stepped upon and moves to the percussion position, driving the hammer 90 to quickly sway in order to strike a percussion instrument. At this moment, the resilient member 43 is stretched and the resilient force accumulates as well. As such, a torque force is applied on the axle. Such torque force can drive the pedal 14 back to the release position once the pedal 14 is released, as shown in FIG. 7. Due to the deployment of the axial pin, the linkage member sways as the resilient member is pulled by the connecting body. And as shown in FIG. 7 and FIG. 9, the axial pin 45 is also position-adjustable, i.e. the axial pin 45 can be inserted either in the upper bore sets or in the lower bore sets. And the distance between the axial pin 45 and the second end of the resilient member is, therefore, adjustable. As shown in FIG. 8 and FIG. 10, the linkage member sways as the resilient member is stretched to slightly reduce the distortion of the resilient member.

What is claimed is:

1. A pedal system for a percussion instrument, comprising:

a support element, having a pedal, at least one upright frame and a positioning unit, the pedal being swayable between a release position and a percussion position, an axle being rotatably disposed on the upright frame;

a connecting shank, disposed on the axle in a rotational operative relationship;

a transmission element, connecting the pedal with the connecting shank, the connecting shank along with the axle being rotatable as the pedal pivoting between the release position and the percussion position; and a returning element, comprising a connecting body, a resilient member, a linkage member, an axial pin and a rod member, the connecting body being disposed on the axle in a rotational operative relationship, the resilient member having a first end and a second end, the first end of the resilient member being connected to the connecting body, the linkage member connecting the second end of the resilient member with the rod member, the rod member being height-adjustably disposed on the positioning unit, the axial pin being disposed between the linkage member and the rod member so that the linkage member being rotatable with respect to the rod member about the axial pin, the axial pin being movable at least between a first position and a second position so that a distance between the axial pin and the second end of the resilient member being adjustable.

2. The pedal system of claim 1, wherein the linkage member is formed with multiple bore sets, the axial pin is detachably inserted into one of the bore sets.

3. The pedal system of claim 1, wherein the linkage member is formed with a longitudinal slot, the axial pin is slidably inserted in the longitudinal slot, and the axial pin is selectively fixed at a position between both ends of the longitudinal slot.

4. The pedal system of claim 3, wherein the axial pin having a head portion and a body portion axially extending from the head portion, the body portion mates with a nut so that the axial pin can be fixed on the linkage member.

5. The pedal system of claim 1, wherein the positioning unit is formed with a through hole, the rod member inserts through the through hole of the positioning unit, at least one nut is threaded on the rod member and abuts against the positioning unit.

* * * * *